US005386805A

United States Patent [19]

Abe et al.

[11] Patent Number: 5,386,805

[45] Date of Patent: Feb. 7, 1995

[54] COOLING SYSTEM OF AN INTERNAL COMBUSTION ENGINE

[75] Inventors: Shizuo Abe; Masato Kawauchi, both of Mishima; Kiyoshi Nakanishi; Masayoshi Tokoro, both of Susono; Yoshimasa Watanabe, Shizuoka, all of Japan

[73] Assignee: Toyota Jidosha Kabushiki Kaisha, Aichi, Japan

[21] Appl. No.: 150,798

[22] Filed: Nov. 12, 1993

Related U.S. Application Data

[63] Continuation of Ser. No. 890,172, May 29, 1992, abandoned.

[30] Foreign Application Priority Data

| | | | |
|---|---|---|---|
| Jun. 6, 1991 | [JP] | Japan | 3-135147 |
| Jul. 1, 1991 | [JP] | Japan | 3-160496 |
| Jul. 1, 1991 | [JP] | Japan | 3-160497 |
| Nov. 28, 1991 | [JP] | Japan | 3-314777 |

[51] Int. Cl.[6] ..... F02B 75/18

[52] U.S. Cl. ..... 123/41.28; 123/41.79

[58] Field of Search ..... 123/41.74, 41.79, 41.83, 123/41.84, 41.28

[56] References Cited

U.S. PATENT DOCUMENTS

| | | | |
|---|---|---|---|
| 1,680,567 | 8/1928 | Pitzman | 123/41.28 |
| 1,754,689 | 4/1930 | MacPherson | 123/41.74 |
| 2,078,499 | 4/1937 | Ljungstrom . | |
| 5,031,579 | 7/1991 | Evens | 123/41.74 |

FOREIGN PATENT DOCUMENTS

| | | |
|---|---|---|
| 63-168242 | 11/1988 | Japan . |
| 2-130246 | 5/1990 | Japan . |
| 3-51701 | 3/1991 | Japan . |

*Primary Examiner*—Noah P. Kamen
*Attorney, Agent, or Firm*—Oliff & Berridge

[57] ABSTRACT

A cooling system of an internal combustion engine has a plurality of cylinder coolant passages. Each of the passages is provided for one of a plurality of cylinders. The plurality of cylinder coolant passages has grooves provided on outer surfaces of cylinder liners of the plurality of cylinders. The system also includes a cylinder head coolant passage located so as to extend in a cylinder head and a coolant supply for supplying coolant to the cylinder head coolant passage. The cylinder head coolant passage has branch passages connected therewith, each of the branch passages being also connected with respective one of the plurality of cylinder coolant passages.

15 Claims, 14 Drawing Sheets

COOLING SYSTEM OF AN INTERNAL COMBUSTION ENGINE

This is a continuation of application Ser. No. 07/890,172, filed May 29, 1992, now abandoned.

BACKGROUND OF THE INVENTION (1) Field of the Invention

The present invention generally relates to a cooling system of an internal combustion engine, and more particularly to a cooling system for cooling a cylinder and/or a cylinder head.

(2) Description of the Related Art

Japanese Laid-Open Utility Model Application No. 168242 discloses a cooling system for cooling an internal combustion engine by passing a coolant through a spiral or ring-shaped passage formed on an outer surface of a cylinder liner.

FIGS. 1A, 1B, and 1C are plan, front, and side views of a conventional cylinder liner, respectively. A plurality of ring-shaped passages 11, each formed in-a plane roughly perpendicular to the longitudinal axis of the cylinder liner are spaced apart from each other at equal intervals in a longitudinal axial direction of the cylinder liner 10. All the passages 11 are coupled to each other by means of connection passages 12 and 13 formed in the axial direction of the cylinder liner 10. A coolant is poured into the cylinder liner 10 via an inflow part 14, and is distributed into the ring-shaped passages 11 via the connection passage 12. The cylinder is cooled while the coolant is flowing in the ring-shaped passages 11. After flowing through the cylinder, the coolant flows into the connection passage 13, and the coolant collected in the connection passage 13 is discharged via a flux part 15.

FIGS. 2A and 2B are respectively system diagrams of cooling systems, which are used for multi-cylinder engines; these cooling systems cool cylinders by means of such cylinder liners.

In the system shown in FIG. 2A, coolant is pressurized by a pump 21, and then the coolant flows in parallel cylinder coolant passages 23*a*, 23*b*, 23*c*, 23*d*. An outlet of the pump 21 separates into the passages 23*a*–23*d* each of which passages is provided for the respective cylinders, which cylinders are formed in a cylinder block 22. After flowing through the passages 23*a*–23*d*, the coolant is collected and then it flows into a cylinder head coolant passage 25. The coolant thus returns to the pump 21 via a radiator 26 and a thermostat 27.

In a system shown in FIG. 2B, coolant pressurized by a pump 21 is distributed into a cylinder block 22 side and a cylinder head 24 side, then coolant distributed into the cylinder block 22 side flows into cylinder coolant passages 22*a*, 22*b*, 22*c* and 22*d*, while coolant distributed into the cylinder head 24 side flows into a cylinder head coolant passage 25, in parallel. Both of the coolant flows are thus collected so as to flow into a radiator 26.

The cylinder coolant passages such as those shown in FIGS. 1A through 1C have a high cooling ability. In a construction of a cooling system such that cold coolant is directly provided to the cylinder coolant passages, in a cold state of the engine, a temperature on an inner surface of a cylinder liner is too low, and friction energy loss due to a piston reciprocating in the cylinder liner will increase. Further, the clearance between the outer surface of the cylinder liner and the inner surface of a bore of the cylinder block will increase as the temperature of the liner decreases. As the cylinder liner is fitted in the bore, this results in a diminishing of the sealing ability for sealing coolant in a space between the outer surface of the cylinder liner and the inner surface of a bore of the cylinder block.

Further, in the construction shown in FIGS. 2A and 2B, bubbles generated in the pump 21 flow into the cylinder coolant passages 24*a* through 24*d* directly. It is then difficult to remove the bubbles in the cylinder coolant passages 24*a*–24*d*, which are constructed as shown in FIGS. 1A–1C. There has been a problem in that these bubbles staying in the passages 24*a*–24*d* may make the cylinder liner corrode.

A cooling system, wherein coolant is provided to coolant passages of a cylinder liner after passing through a cylinder head coolant passage, is disclosed in Japanese Laid-Open Patent Application No. 2-130246. However, this cooling system may cause a problem such that a sufficient amount of coolant may not be provided to cylinder coolant passages if the cooling system is applied to an engine having a plurality of cylinders, because pressure of the coolant may be expended during passage through a cylinder head cooling passage before the coolant flows into the cylinder coolant passages. Thus, this lack of coolant pressure, and resulting lack of coolant supplied to the cylinder coolant passages prevents the cylinders from being cooled sufficiently.

A combustion chamber of an engine consists of a cylinder block and a cylinder head, the cylinder block having some cylinders located therein, and the cylinder head having a concavity on a bottom surface thereof. Outer surfaces of cylinder liners are fitted in inner surfaces of bore parts formed in the cylinder block. Thus, a high temperature generated by engine operation in the combustion chamber result in heat being transmitted into the cylinder liners and other parts via the cylinders and the cylinder head.

The present applicant disclosed a cooling system having a construction such as shown in FIG. 3 in Japanese Patent Application No. 3-51701. A cooling system such as the above mentioned is a cooling system of an internal combustion engine, the cooling system effecting cooling by means of the so-called groove cooling method. The groove cooling method is a method wherein coolant flows into coolant passages. The coolant passages are formed between the inner surfaces of the bore parts of the cylinder block and the outer surfaces of the cylinder liners. The coolant flowing into the coolant passages cools a wall of the cylinder liner and the flowing of coolant in the coolant passages prevents the coolant from boiling.

In the FIG. 3, a plurality of ring-shaped grooves 33 each having rectangular sectional areas are formed on an outer surface of a cylinder liner 32 each in a plane perpendicular to a longitudinal axial direction of the cylinder liner 32. The plurality of ring-shaped grooves 33 are spaced apart from each other at equal intervals along a longitudinal axis of the cylinder liner. The cylinder liner 32 is fitted in a cylinder block 31. Ring-shaped coolant passages are formed by the plurality of ring-shaped grooves 33 when each cylinder liner 32 is fitted into corresponding bore parts of the cylinder block 31.

Further, longitudinal grooves 35*a*, 35*b*, 36*a*, and 36*b* are formed on both the outer surface of each cylinder liner 32 and the inner surface of the corresponding bore part of the cylinder block 31, along the longitudinal axial direction of the cylinder liner 32, in positions such that corresponding longitudinal grooves are opposite to each other, so as to form passages connecting the above mentioned ring-shaped grooves 33 with each other. Also inflow passages 37*a*, 37*b* are formed in the cylinder block 31. One side of each of the passages is connected with the respective longitudinal grooves 35*a* and 35*b*. Flux passages 38*a* and 38*b* are formed in the cylinder block 31, in a diametrically opposite location. One side of each of the passages is connected with the respective longitudinal grooves 36*a* and 36*b*.

A pump 39 discharges coolant so as to distribute it into two flow paths of coolant. The pump 39 then provides one of the coolant flow paths to the inflow passage 37*a* via a filter 40, at a high pressure thereof, while the pump 39 provides the other coolant flow path to the flux passage 37*b* directly, at a low pressure thereof. The coolant in the inflow passage 37*a* is distributed into the ring-shaped grooves located in an upper side, as in FIG. 3, of the cylinder liner 32 via the longitudinal groove 35*a*, then the coolant passes around the outer surface of the cylinder liner 32 and is consequently discharged from the longitudinal groove 36*a* via the flux passage 38*a*. On the other hand, the coolant in the inflow passage 37*b* is distributed into the ring-shaped grooves located in a lower side, as in FIG. 3, of the cylinder liner 32 via the longitudinal groove 35*b*, then the coolant passes around the outer surface of the cylinder liner 32, and is consequently discharged from the longitudinal groove 36*b* via the flux passage 38*b*. The coolant discharged from the flux passages 38*a* and 38*b* is collected so as to be returned to the pump 39 via a radiator (not shown in the drawing).

In the above mentioned disclosed system, heat generated in the combustion chamber is transmitted into the cylinder liner via the cylinder head, the heat is reduced by means of cooling the wall of the cylinder liner 32. An incoming heat distribution of the wall of the cylinder liner 32 is such that an upper part, as in FIG. 3, which part is nearest to the combustion chamber, is the hottest part and the lower part is at a lower temperature.

Thus, to make it possible to cool the wall of the cylinder liner 32 uniformly, it is necessary that a coolant flow rate in the ring-shaped grooves 33 located nearest to the combustion chamber is largest, and that a coolant flow rate in the ring-shaped grooves located farther from the combustion chamber, is smaller, as shown by a solid line curve 'c' of FIG. 4.

In the system shown in FIG. 3 if sectional areas of the longitudinal grooves 35*a*, 35*b*, 36*a*, 36*b* are larger than a predetermined amount, a distribution of coolant flow rate in the ring-shaped grooves 33 becomes such that a flow rate is uniform in all parts of each of the ring-shaped grooves 33 between the uppermost part and the lowest part thereof as shown by a broken line 'a' of FIG. 3. On the other hand, if the sectional areas of the longitudinal grooves 35*a*, 35*b*, 36*a*, and 36*b* are reduced to an amount less than the predetermined amount, a flow rate in an upper part of the ring-shaped grooves 33, as in FIG. 3, is greater as shown by a broken line 'b' of FIG. 4, so that an incoming heat distribution in the ring-shaped grooves 33 becomes more similar to that shown in the solid line 'c' of FIG. 4.

However, it may be difficult to equate a distribution of flow rate of coolant flowing in the ring-shaped grooves to the distribution of the heat incoming to the cylinder liner 32 because the difference of flow rates is too large. The difference of flow rates occurs between a flow rate in an uppermost part of the ring-shaped grooves and a flow rate in a lower part of the ring shaped grooves. This difference is shown by the broken line curve 'b' of FIG. 4. The reason for the above mentioned difference in produced flow rates will be described below. The inflow passage 37*a* and the longitudinal groove 35*a* are connected with each other so as to intersect each other at a right angle at a connecting point thereof. Coolant flowing into the uppermost groove 33 flows straight and does not have to make the right angle turn at the connecting point between the inflow passage 37*a* and longitudinal groove 35*a*. The groove 33 extends along the same line as a line in which the inflow passage 37*a* extends, as shown in FIG. 3. On the other hand, coolant flowing into the ring-shaped grooves 33 located lower than uppermost groove 33, must make the right angle turn at the connecting point between the inflow passage 37*a* and the longitudinal groove 35*a*. As a result, a flow rate of coolant flowing in the ring-shaped grooves 33 located lower than the uppermost groove 33 is small, because of the large pressure loss incurred in the right-angle connecting point between the inflow passage 37*a* and the longitudinal groove 35*a*. Therefore, coolant flows mainly along arrows shown in the FIG. 3.

Another example of a cooling system having ring-shaped passages formed in a cylinder liner in a fitted position in the cylinder block relating to the present invention is shown in FIG. 5. In FIG. 5, a groove 4 having a rectangular sectional area is formed on an outer surface 53 of the cylinder liner 51 spirally, the cylinder liner 51 having a rim part 52 at a top position thereof. The cylinder liner 51 is fitted into an inner surface 56 of a bore formed in a cylinder block 55 so that the outer surface 53 of the cylinder liner 51 is in contact with the inner surface 56 of the bore of the cylinder block 55. Thus, a spiral-shaped coolant passage 57 consists of the groove 54 and the inner surface 56 of the bore.

In this construction of the coolant passage of the cooling system, a shock absorbing function of the cylinder liner 51 is not sufficient when an inner wall of the cylinder liner 51 is deformed by a side pressure of a piston or a combustion pressure, due to contact of the outer surface 53 of the cylinder liner 51 with the inner surface 56 of the bore of the cylinder block 55. Thus, the inner wall of the cylinder liner 51, which is constructed to retain engine oil thereon, suffers from mirror abrasion due to a deficiency of the shock absorbing function of the cylinder liner 51. Therefore, there have been problems with the retaining-oil function of the inner wall of the cylinder liner 51 becomes diminished, and noise generated by piston movement becomes large.

Further, there has been another problem with electrolyte etching caused in the cylinder liner surface 51 which is in contact with the bore of the cylinder block 55. Electrolyte etching occurs if the cylinder liner 51 is made of cast iron and the cylinder block 55 is made of aluminium. As electrolyte etching is caused when metals of different kinds are in contact with each other.

SUMMARY OF THE INVENTION

The general object of the present invention is to provide a cooling system of an internal combustion engine for cooling a cylinder head and a cylinder liner effectively. To achieve the general object of the present invention, a first particular object of the present invention is to provide a cooling system of an internal combustion engine for preventing a friction energy loss resulting from friction between a piston and the cylinder liner by preventing the cylinder from being cooled excessively in a cold state of the engine, the cooling system having a sufficient sealing property against coolant leaking therefrom, the cooling system preventing corrosion and rust of a cylinder coolant passage produced due to bubbles, and the cooling system having sufficient coolant for cooling the cylinder, thus overcoming the disadvantages of the related technology.

To achieve the first particular object of the present invention, a cooling system of an internal combustion engine according to the present invention comprises:

a plurality of cylinder coolant passages, each of the passages being provided for a respective cylinder of a plurality of cylinders, the plurality of cylinder coolant passages comprising grooves provided on outer surfaces of cylinder liners of the plurality of cylinders;

a cylinder head coolant passage extending around a cylinder head; and coolant supply means for supplying coolant to the cylinder head coolant passage; and branch passages connected with the cylinder head coolant passage, each of the branch passages being also connected with a respective one of the plurality of cylinder coolant passages.

In the above mentioned construction, excess cooling of the cylinders and increase of friction energy loss are prevented, and sufficient sealing property against coolant leakage is ensured, because coolant having some amount of heat obtained by passing through the cylinder head coolant passage, is provided for the cylinder coolant passages. Also, the number of bubbles coming into the cylinder coolant passages is reduced, and the producing of corrosion and rust are prevented in the cylinder coolant passages because the undesired bubbles in the coolant are removed in the cylinder head coolant passage during passage of coolant there, in a relatively large flow rate thereof. Further, sufficient coolant is provided for the cylinder coolant passages because coolant is distributed into each of the cylinder coolant passages from the cylinder head coolant passage halfway, at a point where each of the branch passages is connected with the cylinder head cooling passage. The coolant at this point still retaining retains some pressure, while a part of the original pressure given by a discharging pump has already been expended at the cylinder head coolant passage during passage of the coolant therein.

Another particular object of the present invention is to provide a cooling system wherein even if the cooling system has the above mentioned construction, there is no problem with sufficient coolant being provided to cylinder coolant passages despite the resistance of the cylinder coolant passages to the flow of coolant being larger than resistance of the cylinder head coolant passage to the flow of coolant.

To achieve the particular object of the present invention it is necessary to provide a cooling system having the above mentioned construction wherein:

the cylinder head coolant passage comprises a plurality of coolant passages, each of the passages extending in the cylinder head; and the plurality of coolant passages of the cylinder head coolant passage being connected to each other.

In the above mentioned construction, sufficient coolant is provided for the cylinder coolant passages because it is possible to minimize a difference of resistances to coolant flow between the cylinder head coolant passage and the cylinder coolant passages by causing the resistance in the cylinder head coolant passage to become larger by minimizing a sectional area of each of the plurality of coolant passages of the cylinder head coolant passage.

Another particular object of the present invention is to provide a cooling system wherein a flow rate distribution of coolant flowing in all of the coolant passages of each cylinder is uniform. To achieve this particular object, a cooling system is provided having the above mentioned construction provided to achieve the above mentioned first particular object of the present invention wherein:

each of the cylinder coolant passages comprises a plurality of coolant passages located in a column, the column being located along a longitudinal axial direction of a cylinder liner, each of the passages extending in a plane roughly perpendicular to a longitudinal axis of the cylinder liner, the passages being provided between an inner wall of a cylinder block and an outer wall of the corresponding cylinder liner, the cylinder liner being fitted in the cylinder block. Each of the cylinder coolant passages also comprises a coolant inflow passage for supplying coolant to each passage of the plurality of coolant passages; and the plurality of coolant passages and the coolant inflow passage being located so that each of the pressure losses of coolant flowing through positions where coolant are supplied to the plurality of coolant passages from the coolant inflow passage is roughly identical to each other.

In the above mentioned construction, it is possible to product a substantially uniform flow rate distribution of coolant flowing in all of the plurality of coolant passages of each of the cylinders, by substantially equalizing pressure losses of coolant respectively flowing through passages from the coolant inflow passage to the plurality of coolant passages.

Another particular object of the present invention is to provide a cooling system wherein deformation of a cylinder liner due to a side pressure exerted by piston and/or a combustion pressure, and a resulting mirror abrasion of an inner wall of the cylinder liner is prevented. This preserves the retaining engine oil property of the inner wall of the cylinder liner, and also prevents both an increase of noise generated by a piston movement, and an electrolyte etching produced in a position in which the cylinder liner is in contact with the cylinder block.

To achieve the above mentioned particular object, the cooling system having the above mentioned construction provided to achieve the above mentioned first particular object of the present invention is provided, wherein:

each of the cylinder coolant passages comprises a groove provided on at least one of an inner wall of a cylinder block and an outer wall of a cylinder liner, the cylinder liner being fitted in a respective cylinder block, a clearance being provided between the inner wall of the cylinder block and the outer wall of the cylinder block except for positions where each of the cylinder coolant passages are located, the clearance being appropriately smaller than a radial-direction depth of the coolant groove.

In the above mentioned construction, it i possible to make the cylinder liner able to perform a large shock absorbing function if an inner wall of the cylinder liner is deformed due to the above mentioned pressures, and thus the mirror abrasion of the inner wall of the cylinder liner can be prevented. Further, it is possible to ensure the property of retaining of engine oil on the inner wall of the cylinder liner, to prevent an increase of the noise of piston movement, and prevent electrolyte etching.

As a result, in the cooling system according to the present invention, it is possible to cool a cylinder liner and a cylinder head effectively.

Other objects, features and advantages of the present invention will become more apparent from the following detailed description when read in conjunction with the accompanying drawings.

DESCRIPTION OF THE PREFERRED EMBODIMENT

Figure 1A:
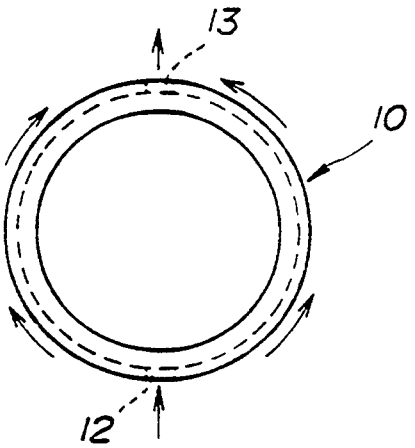
FIG. 1A (RELATED ART)
FIGS. 1A, 1B and 1C show a construction of a cylinder liner, a part of which cylinder liner forms a part of a cooling system relating to the present invention.

A construction of a first embodiment of a cooling system according to the present invention is described below in conjunction with FIG. 6.

In the drawing, coolant discharged from a pump 61 flows in one direction in a cylinder head coolant passage 63 located in a cylinder head 62, the coolant flowing along a line, in which line cylinders are located in a row.

Figure 1B:
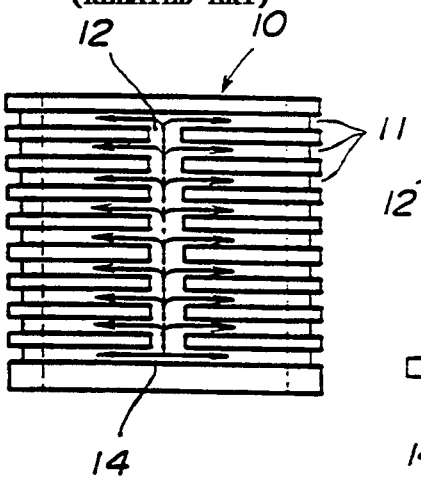
FIG. 1B (RELATED ART)
Figure 1C:
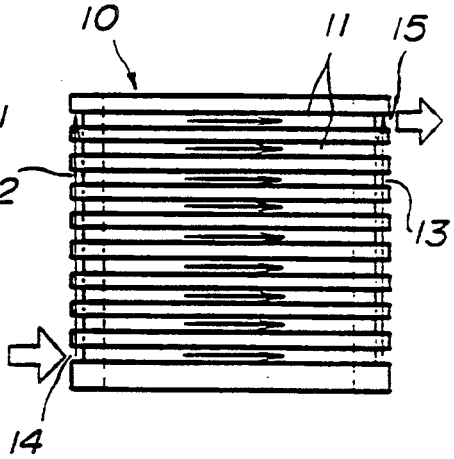
FIG. 1C (RELATED ART)
Figure 2B:
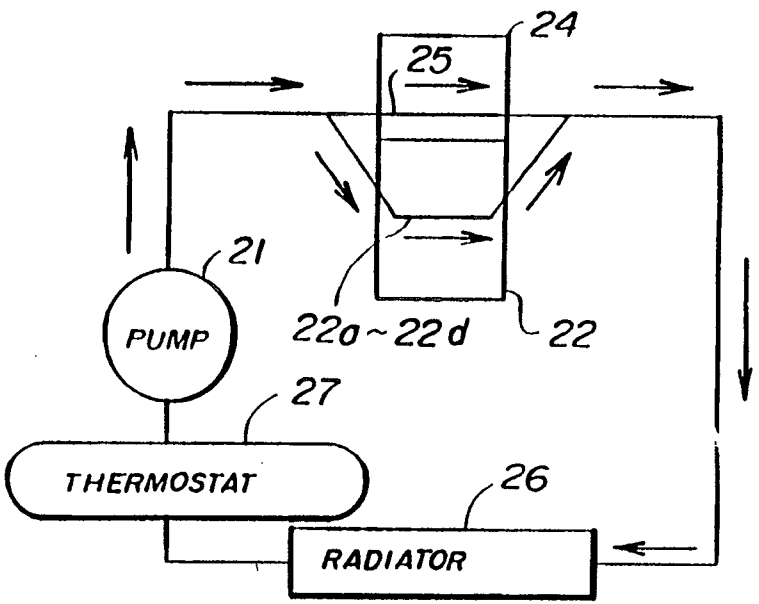
FIG. 2B (RELATED ART)
FIGS. 2A and 2B respectively show examples of constructions of cooling systems relating to the present invention.
Figure 2A:
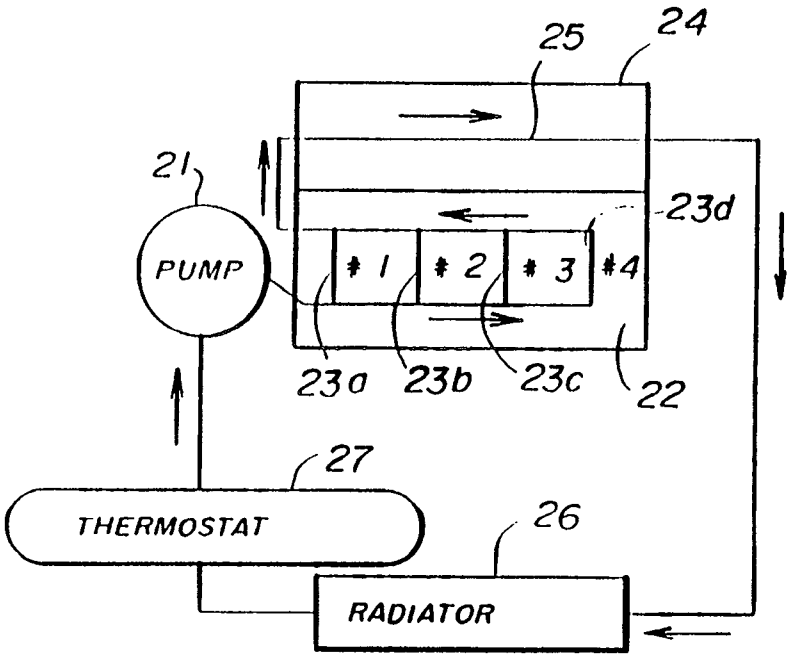
FIG. 2A (RELATED ART)

In the cylinder block 64, coolant passage 65*a*, 65*b*, 65*c* and 65*d* are located. Each of coolant passages 65*a*–65*d* are provided separately for each one of the cylinders. Each of the coolant passages is for example, like the coolant passages 11 shown in the FIGS. 1A–1C. Coolant flowing in the cylinder head coolant passage 63 is distributed into the cylinder coolant passages 65*a*–65*d* along respective branches connected with the cylinder coolant passages 65*a*–65*d*. Coolant flowing out of each of cylinder coolant passages 65*a*–65*d* is collected in a cylinder connecting passage 66, the coolant is then added to another coolant portion in a connecting passage 68, the other coolant having flowed out of the cylinder coolant passage 63 and having flowed into a passage 67. Then the coolant, the amount of which has increased in the connecting passage 68, flows into a radiator 69. After being cooled in the radiator, the coolant is returned into the pump 61 via a thermostat 70.

Thus, an inner surface of a cylinder liner provided for each of the cylinders will not be cooled excessively even if the engine is in the cold state because coolant having some heat received in the cylinder head coolant passage 63, is provided to each of the cylinder coolant passages 65*a*–65*d*. Therefore, an increase of friction energy loss due to piston movement can be prevented, and also an enlargement of a clearance provided between the cylinder liner and the cylinder block can be prevented, thus preventing a diminishing of the sealing property provided between the cylinder liner and the cylinder block. Further, some undesired bubbles in the coolant may flow in the cylinder head coolant passage 63, but few of them flow into the cylinder coolant passages 65*a*–65*d* because a coolant flow rate of coolant flowing in the cylinder head coolant passage 63 is much larger than a coolant flow rate of coolant flowing in each of the cylinder coolant passages 65*a*–65*d*, and because the cylinder head coolant passage 63 is located in a position above each of the cylinder coolant passages. Coolant distributed upstream of the cylinder head coolant passage 63 into the cylinder coolant passage 65*a* has more bubbles than the coolant distributed into the cylinder coolant passage 65*d* because the coolant distributed into the passage 65*a* has not flowed through the cylinder head coolant passage 63 a longer time than the coolant distributed into the passage 65*d*, and a function of removing bubbles in the cylinder head coolant passage 63 has not been effectively performed on the coolant. However the undesired bubbles in the coolant distributed into the passage 65*a* can be removed therefrom faster than the bubbles may be removed from the coolant distributed into the passage 65*d* because a flow rate of the coolant flowing in the cylinder coolant passage 65*a* is greater than a flow rate of cooling flowing in the passage 65*c*. The coolant flow in passage 65*a* has a greater flow rate than that in passage 65*d* because coolant in passage 65*a* is distributed upstream of passage 63 and has a higher pressure than coolant in passage 65*d*. Also, coolant from which most of the bubbles have been already removed in the passage 63 is supplied to passage 65*d*. Although a flow rate of the coolant flowing in the passage 65*d* is smaller than that of the coolant in the passage 65*a*, bubbles in the coolant in passage 65*d* are not removed faster than in passage 65*a*. As a result, bubbles contaminating coolant flowing in the passages 65*a*–65*d* are quickly removed or have been already removed before flowing into the passages. Thus, it is possible to reduce corrosion and rust produced in the passages which are caused by bubbles in the coolant.

Figure 6:
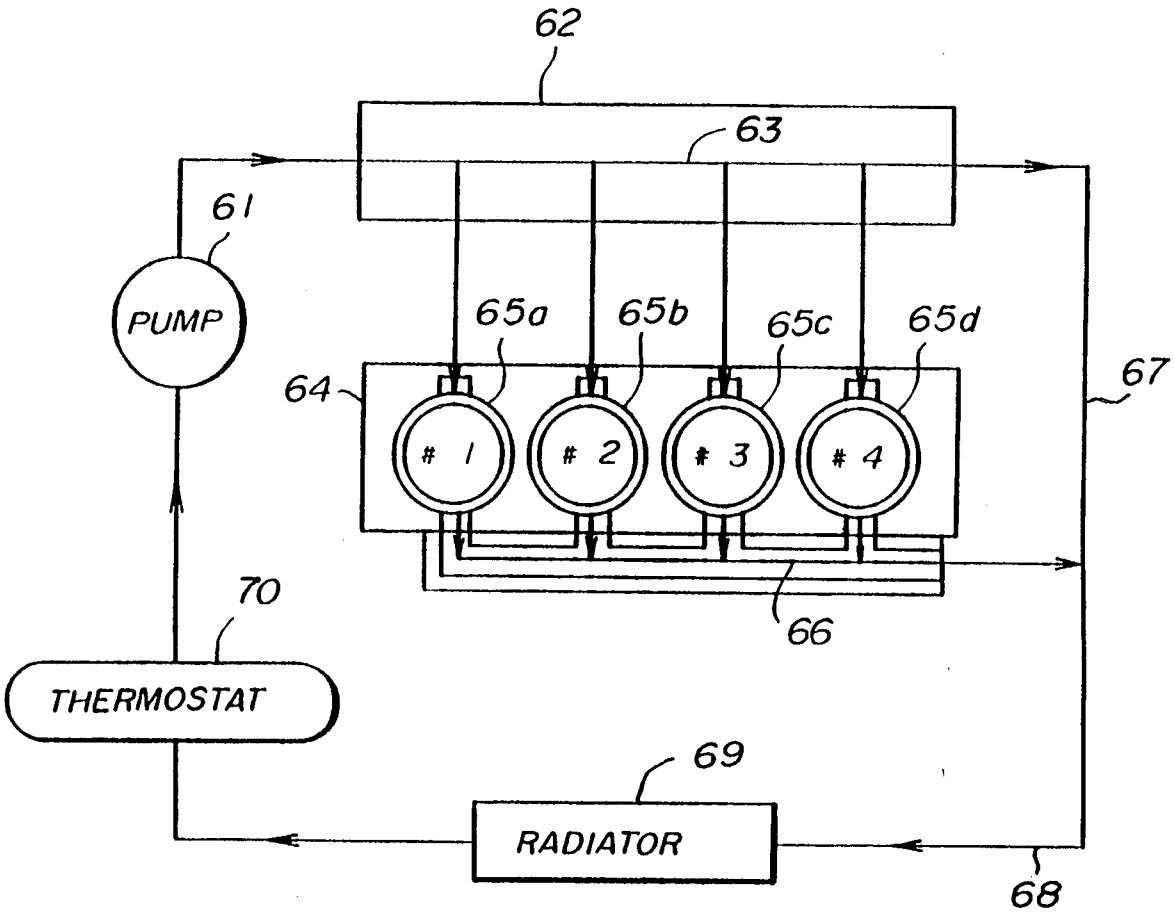
FIG. 6 shows a first embodiment of a cooling system of an internal combustion engine according to the present invention.

Further, in the construction shown in FIG. 6, each of the cylinders can be sufficiently cooled because coolant generally does not suffer much pressure loss in the cylinder passage 63 because the coolant is distributed from the cylinder head coolant passage 63 into each of the cylinder coolant passage 65*a*–65*d* in order. That is, coolant is not provided for the passages 65*a*–65*d* from the end of the cylinder head coolant passage 63 in which coolant has already suffered pressure loss.

A second embodiment of a cooling system according to the present invention will be described below in conjunction with FIG. 7. The same numerals are given to parts of the system shown in FIG. 7, as are given to the corresponding parts of the system shown in FIG. 6, and a description of these parts will be omitted.

Figure 7:
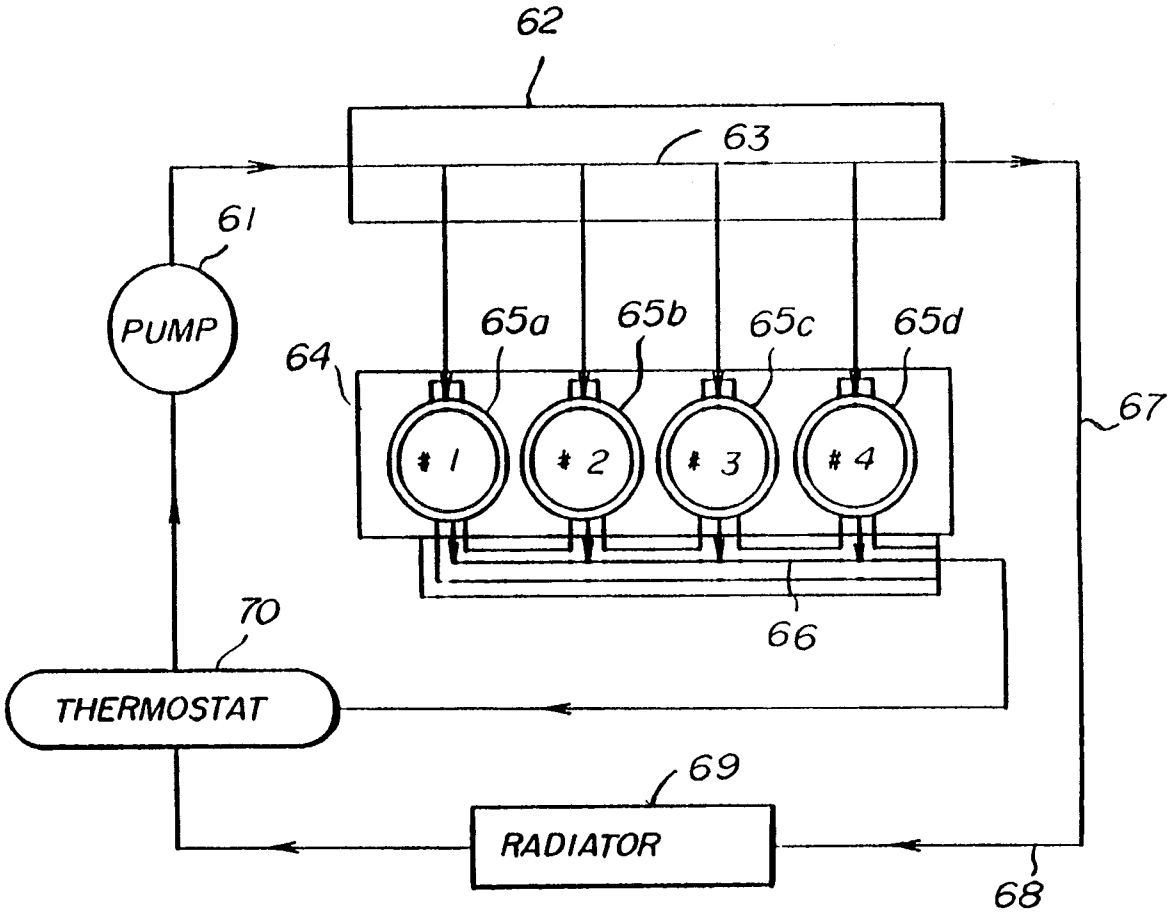
FIG. 7 shows a second embodiment of a cooling system of an internal combustion engine according to the present invention.

In FIG. 7, coolant flowing out of the cylinder coolant passages 65*a*–65*d* and then collected in the cylinder connecting passage 66 is supplied to the thermostat 70, the coolant bypassing the radiator 69.

Thus, a pressure loss that occurs in the cylinder head coolant passage 63, which passage has a construction making it relatively easy for coolant to flow, and a pressure loss that occurs in the radiator 69 are balanced with a pressure loss occurring in the cylinder coolant passages 65*a*–65*d*, each of which passages has a construction offering relatively more resistance to coolant flow. The meaning of 'balanced' as mentioned above is that both pressure losses of coolant relatively flowing in each of the coolant passages 65*a*–65*d* and in the radiator 69 are substantially identical to each other. Thus both pressure losses of coolant flowing in a series of passages comprising the pump 61, the cylinder head coolant passage 62, the pipes 67 and 68, the radiator 69, and thermostat 70, and in a series of passages comprising the pump 61, the cylinder head coolant passage 62, each of the coolant passages 65*a*–65*d*, and thermostat 70 are substantially identical to each other. Therefore, sufficient amount of coolant is provided for the cylinder coolant passages 65*a*–65*d*. Also, it is possible to minimize a flow-rate difference between the cylinder coolant passages 65*a*–65*d*.

In summarizing the above mentioned description, in the constructions of the cooling systems shown in the FIGS. 6 and 7 respectively, it is possible to prevent an increase of a friction energy loss due to piston movement, to prevent a diminishing of a sealing property preventing coolant leakage, and to prevent forming of corrosion and rust due to bubbles in the cylinders, and it is possible to cool each of the cylinders sufficiently because a sufficient flow of coolant in each of the cylinder coolant passages is ensured. Thus, the cooling systems are very useful for practical use.

However, in the cooling systems as shown in the FIGS. 6 and 7 wherein coolant flows along a line in which the cylinders are located in a row, in some cases, a cylinder head coolant passage sectional area for coolant flow may be much larger than a sectional area for coolant flow in a position where coolant flowing in the cylinder head coolant passage is distributed into each of the cylinder coolant passages. In the above case, a flowing- passage-resistance difference between the cylinder head cooling passage at which distribution into each of the cylinder coolant passages may make it difficult for a sufficient amount of coolant to be distributed into each of the cylinder coolant passages. Thus, the cooling ability for the cylinder part may be lacking when the engine is hot.

Figure 8:
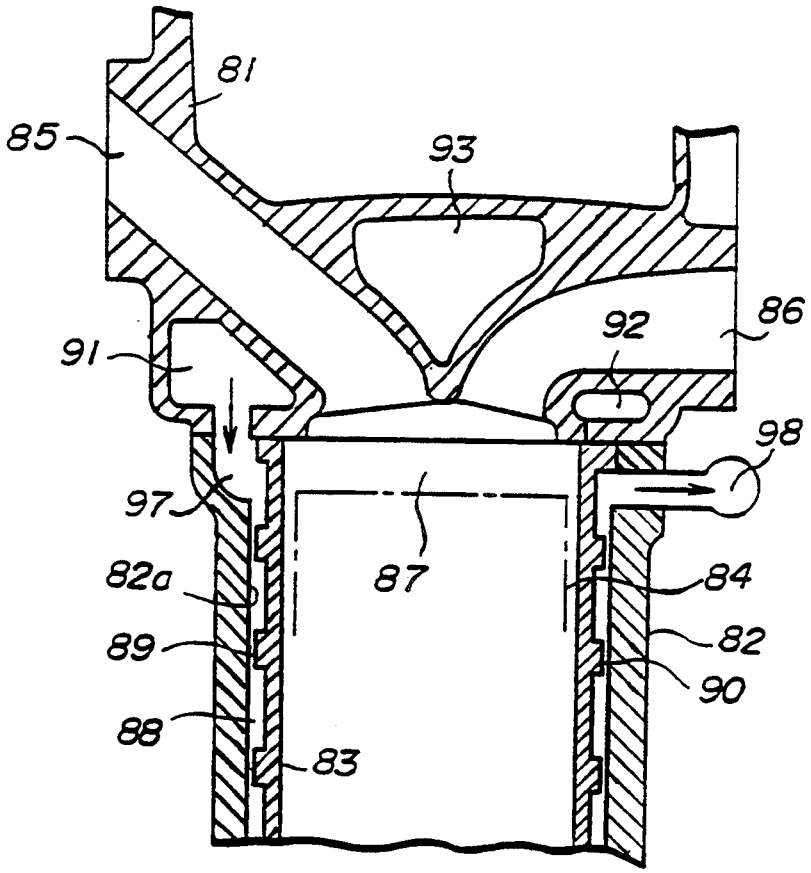
FIG. 8 shows a sectional view of a part of a cylinder head, a part of a cylinder block and a part of a cylinder liner, + which parts form a part of a third embodiment of a cooling system of an internal combustion engine according to the present invention.

To solve a problem such as mentioned above, a third embodiment of a cooling system according to the present invention has a construction as shown in FIGS. 8, 9A–9C, 10, and 11, which construction will be described below. In FIG. 8, a cylinder head 81 is mounted on a top of a cylinder block 82. A cylinder liner 83 is fitted in a bore formed in the cylinder block 82. A piston 84 reciprocates in the cylinder liner 83. An air inlet port 85 and an exhaust port 86 are provided for each of the cylinders. A combustion chamber 87 is formed in a space located at a top of the piston 84 if the piston 84 is located at a top dead point. Further, an inlet valve and an exhaust valve are provided respectively at an end part of the inlet port 85, on a side of the combustion chamber 87, and at an end part of the exhaust port 86 on a side of the combustion chamber 87. However, parts such as the inlet valve, the exhaust valve and an ignition plug are omitted in FIG. 8.

Figure 9A:
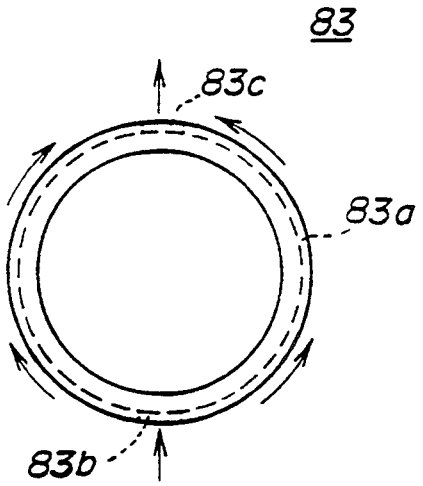
FIGS. 9A, 9B and 9C show a construction of the cylinder liner shown in FIG. 8.
Figure 9B:
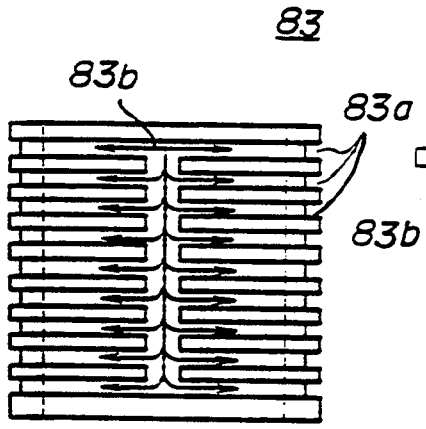
Figure 9C:
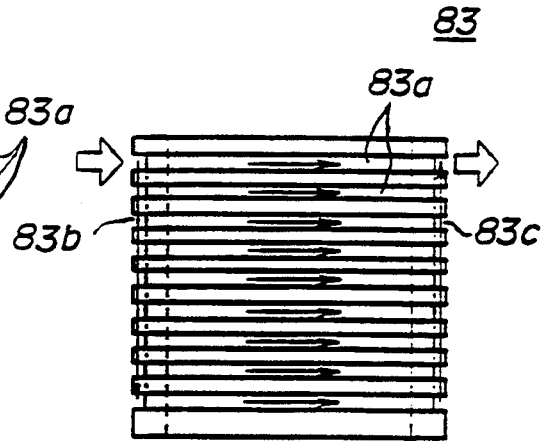

In FIGS. 9A, 9B, and 9C, ring-shaped coolant grooves 83*a* are formed on an outer surface of the cylinder liner 83, and are spaced apart from each other at equal intervals. The grooves 83*a* are located in a column, the located along a longitudinal axial direction of the cylinder liner 83. Further, all of the ring-shaped grooves are connected with each other by means of two connecting grooves 83*b* and 83*c*, 83*b* and 83*c* are formed on the outer surface of the cylinder liner 83 along the longitudinal axial direction of the cylinder liner 83. The cylinder liner 83 having a construction as above mentioned, with reference to FIGS. 8, 9A–9C, is fitted in a bore part 82a formed in the cylinder block 82. Thus, multiple stages of ring-shaped coolant passages 88, a connection passage 89 located in a coolant-inlet side and a connection passage 90 located in a coolant-outlet side, are respectively formed between an outer surface of the cylinder liner 83 and an inner surface of the bore part 82a. These ring-shaped coolant passages 88 and connection passages 89 and 90 correspond to the before mentioned cylinder coolant passage. The passages are used for cooling a cylinder part of the internal combustion engine. That is, they are used for cooling the cylinder liner 83 by means of coolant flowing in the passages.

Three pieces of coolant passages 91, 92, 93 included in the essential parts of the present invention are formed in a cylinder head such as the cylinder head 81 along a line (in a direction perpendicular to the paper in which FIG. 8 is drawn), in which a plurality of cylinders are located in a row. The coolant passage 91 is formed so as to pass under the exhaust port 86 provided for each of the cylinders while the coolant passage 92 is formed so as to pass through a part located between the inlet port 85 and the exhaust port 86, both of ports being provided for each of the cylinders.

The connection passage 89 in the coolant-inlet side of each of the cylinders is connected with the above mentioned coolant passage 91, which passage 91 passes under the inlet port 85, via an inlet part 97. Further, the connecting passage 90 of the coolant-outlet side is connected to a coolant returning pipe 98 provided outside of the cylinder block 82 along a line in which the cylinders are located in a row. Therefore, in FIG. 8, coolant flow is divided from a flow in the coolant passage 91 and coolant flows into a flow in the connection passage 98 via the inlet part 97. Then coolant flow is distributed from the flow in the connecting passage 89 into a flow in each of the ring-shaped coolant grooves 88. Then the coolant flows along the outer surface of the cylinder liner 83. Thus, the coolant cools the cylinder liner 83 and then the coolant is collected in the connecting passage 90 and returned to the coolant returning pipe 98.

Figure 10:
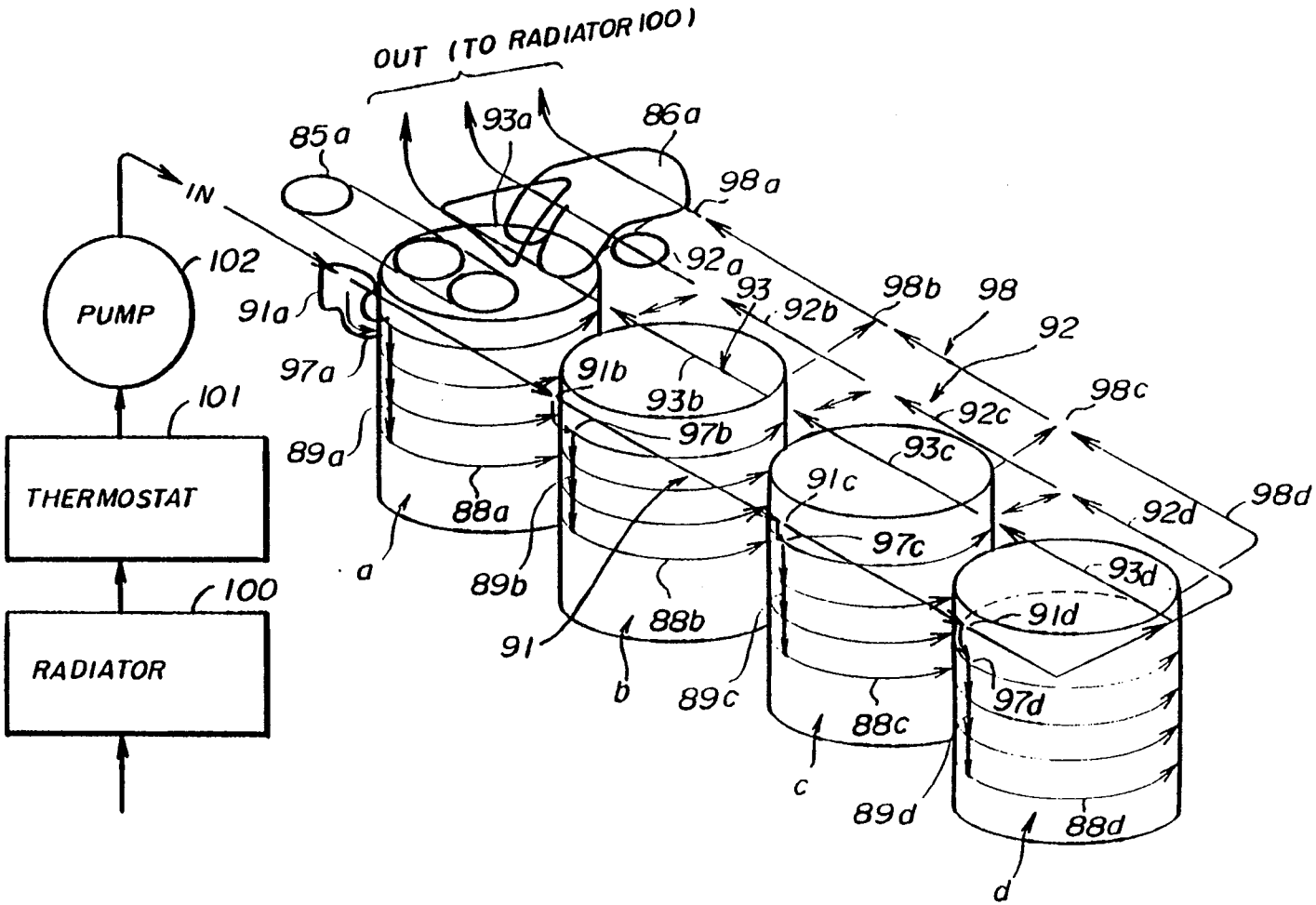
FIG. 10 shows a third embodiment of the cooling system according to the present invention.
Figure 11:
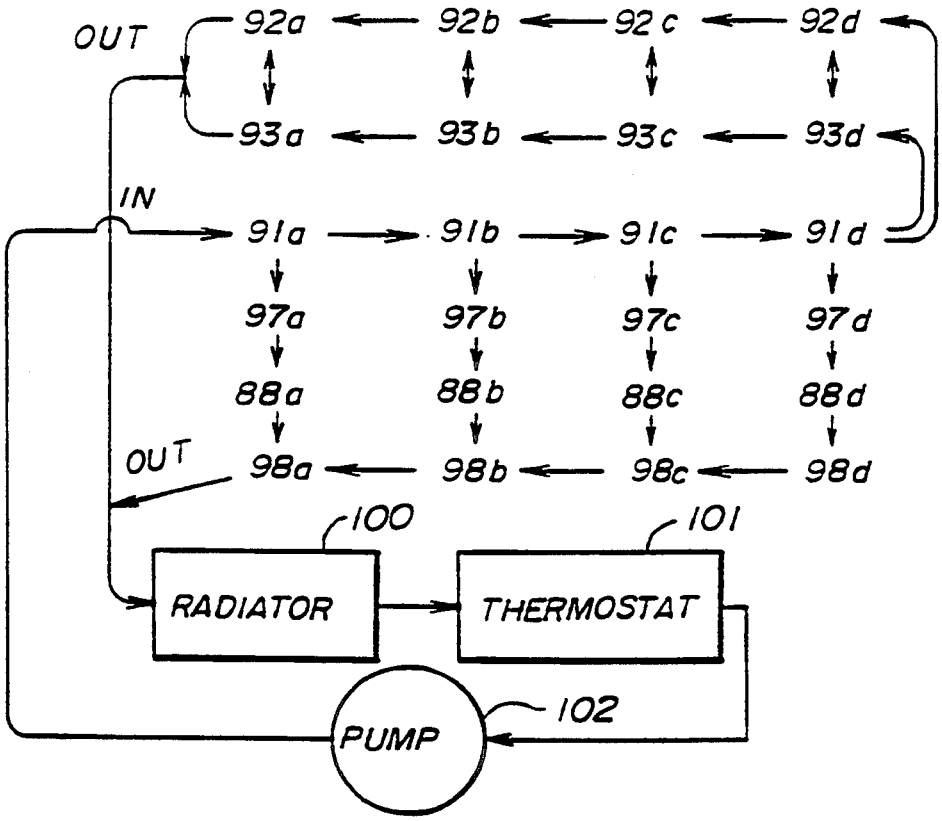
FIG. 11 shows a sequence, by which sequence coolant flows in passages in the cooling system shown in FIG. 10.

FIGS. 10 and 11 show coolant flow routs and coolant flow sequences in the above mentioned third embodiment of the cooling system according to the present invention. The cooling system is applied to a plurality of cylinders 'a', 'b', 'c', and 'd' (in this embodiment, 4 cylinders). In FIG. 10, the same numerals, with symbols 'a', 'b', 'c'. 'd', each corresponding to one of the cylinders, have parts corresponding to the parts shown in FIG. 8, and a description of the parts will be omitted.

As shown in FIGS. 10 and 11, all coolant cooled in a radiator 100 is supplied, via a thermostat 101 and pump 103, to a coolant passage 91*a* located in an end part of the coolant passage 91 on a side of the cylinder 'a'. Then, while the coolant supplied to the coolant passage 91*a* flows from a side of the cylinder 'a' to a side of the cylinder 'd', the coolant flow in the coolant passage 91*a* is divided into inlet parts 97*a*, 97*b*, 97*c*, and 97*d* respectively in the coolant passages 91*a*, 91*b*, 91*c*, 91*d*. Then, in a coolant passage of each of cylinders 'a', 'b', 'c', and 'd', as mentioned in the above description for FIG. 8, after the coolant flow is divided and coolant flows into the inlet parts 97*a*–97*d*, the coolant flows from the inlet parts 97*a*–97*d* up to coolant returning pipes 98*a*, 98*b*, 98*c*, 98*d*, via connection passages 89*a*, 89*b*, 89*c*, 89*d* (each of which passages 89*a*–89*d* extends along an axial direction of each of the cylinders through 'a'–'d') ring-shaped coolant passages 88*a*, 88*b*, 88*c*, 88*d*, and connection passages( not shown in the drawing). Each of the connection passages is located in the opposite side of a respective one of the connection passages 89*a*–89*d*. In each of the coolant returning pipes 98*a*–98*d*, coolant from the ring-shaped coolant passages 89*a*–89*d* is collected as per each of the cylinders 'a'–'d' through. Then, the coolant flows along a line in which the cylinders 'a'–'d' are located in a row, in a direction from the side of cylinder 'd' to the side of cylinder 'a'.

On the other hand, a flow of remaining coolant, which coolant has not been distributed into the cylinder coolant passage of each of the cylinders 'a'–'d', is distributed to the above mentioned coolant passages 92 and 93, then coolant in the passages 92, 93 respectively flows along a line in which the cylinders 'a'–'d' are located in a row, in a direction from the cylinder 'd' side to the cylinder 'a' side. Also, the passages 92 and 93 are connected with each other by means of pipes at points of each of the passages 92, 93, in which parts of the passages 92*a*, 92*b*, 92*c*, 92*d* and 93*a*, 93*b*, 93*c*, 93*d* are near to each other. Coolant flowing through the passages 92, 93 joined after flowing points located above the cylinder 'a', then the coolant is also joined with coolant from the coolant returning pipe 98 and is returned to the radiator 100. Further, in the present embodiment, orifices are provided at positions, in which the coolant passages 92 and 93 are respectively separated from the passage 91. these orifices control ratios of flow rates of coolant flowing in the cylinder coolant passages. Each of the flows has been distributed from coolant flowing in the coolant passage 91 to the passages 92 and 93. The flows have been divided from a flow in the passage 91 in the cylinder 'a'-side end thereof, so that the the coolant flows into the cylinder coolant passages and into passages 92, 93.

In summarizing the above mentioned description, in the third embodiment of the system as shown in the FIGS. 8–10, a coolant passage in the cylinder head 81 is divided into 3 coolant passages 91, 92, 93, and all coolant discharged from the pump 102 is supplied to passage 91. Therefore, a pressure given to coolant in the passage 91 increases because a flow speed of the coolant in the coolant passage 91 increases. Thus, flow rates of coolant flowing in the cylinder coolant passages increase the flows being caused by means of distribution from the passage 91. Thus, the problem occurring as described for the embodiments of FIGS. 6 and 7, is overcome. That is, the problem with an insufficient cooling ability of the system occurring in a hot state of the engine. In particular, in the third embodiment of the cooling system, coolant is supplied to the cylinder coolant passages via a portion of the cylinder head 81 in a side of the inlet port 85, in which the amount of heat received via the inlet air flow in the inlet port 85 is smaller than the amount of heat received by flow of hot air through the exhaust port 86 on a side of the exhaust port 86. Thus, temperature of coolant in the inlet part 97 is restricted to a low value thereof, so that the cooling ability for the cylinder parts is further improved.

Further, in the third embodiment of the cooling system, an inlet-side (left side in FIG. 8) wall of the combustion chamber 87 in the cylinder head 81 and an inlet-side inner surface of cylinder liner 83 are cooled to a greater degree than the cooling degree in similar parts of the exhaust side (right side in FIG. 8). Therefore, occurrence of the knocking phenomena is prevented. Abnormal ignition is prevented so that occurring of the knocking phenomena is prevented by lowering temperature of an inlet-side space of the combustion chamber 87 because the knocking phenomena is often caused by abnormal ignition in the inlet-side space of the combustion chamber 87. The abnormal ignition occurs due to high temperature of exhaust gas which has not been exhausted yet and remains in the inlet-side space of the combustion chamber 87.

Further, in the third embodiment as well as the first and second embodiments as shown in the FIGS. 6 and 7 coolant flow is distributed in order into the cylinder coolant passage of each of the cylinders from the coolant passage 91 of the cylinder head 81. Thus, the third embodiment as well as the first and second embodiments, solves the problems with increase of friction energy loss due to piston movement caused by excess cooling of the cylinder liner 83 in a cold state of the engine, and the diminishing of the sealing property for coolant sealed between the cylinder block 82 and cylinder liner 83. Also, removing of bubbles from coolant will be easy in the third embodiment as well as in the first and second embodiments because coolant is supplied into the cylinder coolant passage in the cylinder block 82 from the coolant passage 91 of the cylinder head 81 located in a position above the cylinder block 82. Therefore production of corrosion and rust caused by bubble contamination in the coolant can be prevented.

Figure 12:
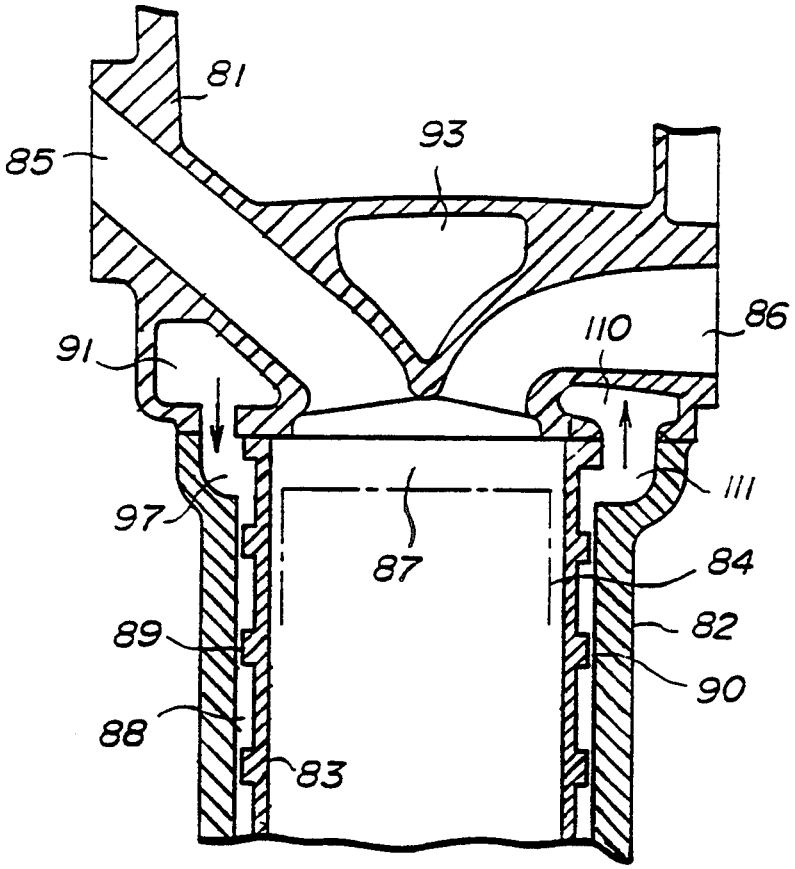
FIG. 12 shows a sectional view of a part of a cylinder head, a part of a cylinder block and apart of a cylinder liner, which parts form a part of a fourth embodiment of a cooling system of an internal combustion engine according to the present invention.

A fourth embodiment of a cooling system according to the present invention will be described below in conjunction with FIG. 12. In FIG. 12, a description of parts, corresponding to the parts shown in FIG. 8 will be omitted and the same numerals given to the parts in FIG. 8 will be given to corresponding parts in FIG. 12.

In the construction shown in FIG. 12, a coolant passage 110 is provided under the exhaust port 86. The coolant passage 110 serves as both the coolant passage 92 located under the exhaust port 86 and the coolant returning pipe 98 of FIG. 8. Also, an outlet part 111, which has a similar shape to the inlet part 97, is provided in a position at the top of a connecting passage 90. The outlet part 111 is connected with the above mentioned coolant passage 110. All parts of the cooling system shown in FIG. 12, except for the above mentioned parts, have the same constructions as those of the third embodiment of the system shown in the FIGS. 8 through 11. Coolant collected in connecting passage of each of the cylinders 'a', 'b', 'c', and 'd' flows into the coolant passage 110 via the outlet part 111. Then the coolant flows from the cylinder 'd' side to the cylinder 'a' side. The coolant cools a bottom part of the exhaust port 86 in the cylinder head 81 when the coolant flows in the coolant passage 110. Generally speaking, temperature of an outer surface of the cylinder liner 83 is lower than that of a circumferential part of the exhaust port 86. Thus, coolant can cool the cylinder head sufficiently when the coolant flows through the coolant passage 110 after the coolant has already cooled the cylinder liner 83 and some amount of heat has been given to the coolant from the cylinder liner 83. Thus, in the construction of the system shown in FIG. 12, it is possible to minimize or simplify the cooling system so as to minimize or simplify the engine in addition to the advantages obtained in the third embodiment as shown in FIGS. 8–11, because effective cooling can be available by the construction of the system as shown in FIG. 12.

Figure 13:
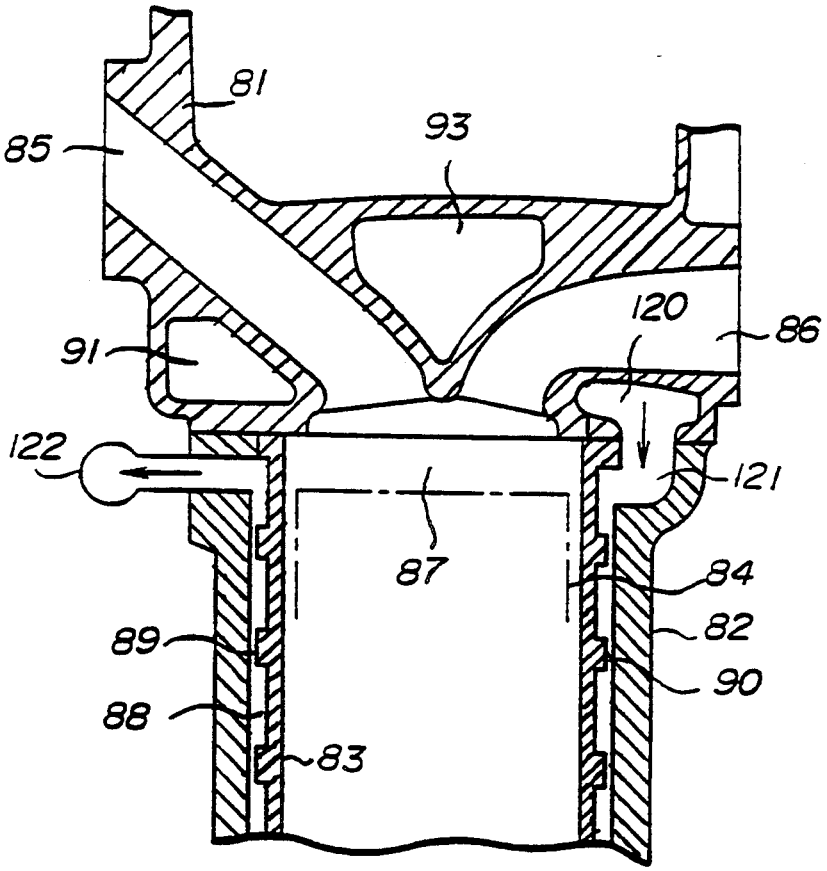
FIG. 13 shows a sectional view of a part of a cylinder head, a part of a cylinder block and a part of a cylinder liner, which parts form a part of a fifth embodiment of a cooling system of an internal combustion engine according to the present invention.

A fifth embodiment of a cooling system according to the present invention will be described below in conjunction with FIG. 13. In FIG. 13, a description of parts, corresponding to the parts shown in FIG. 8 will be omitted and the same numerals given to the parts in FIG. 8 will be given to the corresponding parts in FIG. 13.

In the construction of the fifth embodiment of the system shown in FIG. 13, supply of coolant to a cylinder coolant passage is performed from a side of an exhaust port 86. Constructions of a coolant passage 120 provided, along a line in which the cylinders are provided in a row, under the exhaust port 86 and of an inlet part 121, in which part a coolant flow is distributed into the cylinder coolant passage of each of the cylinders have the same constructions as the coolant passage 110 and the outlet part 111 of the fourth embodiment as shown in FIG. 12 respectively. Also, a coolant returning pipe 122 having a construction similar to the coolant returning pipe 98 in the third embodiment of system as shown in FIG. 8 is provided outside of the cylinder block 82. Therefore, all coolant supplied from a radiator (not shown in the drawing), which coolant has been cooled therein, is supplied to the coolant passage 120. Then, a coolant flow in the passage 120 is distributed into the inlet part 121 of each of the cylinders 'a'–'d', in order, during passing through the passage 120 in a direction from the cylinder 'a' side to the cylinder 'd' side. Coolant, which coolant has cooled each of the cylinders during flowing in the cylinder coolant passages, is collected in the above mentioned coolant returning pipe 122. Then the coolant flows in the passage 122 in a direction from the cylinder 'd' side to the cylinder 'a' side and then the coolant returns to the radiator. Coolant flow which has not been distributed into the cylinder coolant passages from the passage 120, flows into the other coolant passages 91 and 93, and flows in a direction from the cylinder 'd' side to the cylinder 'a' side so as to cool the cylinder head 81.

In the construction of the fifth embodiment of the system as shown in FIG. 13, a warming up property of the cylinder liner 83 in a cold state of the engine is improved because coolant already heated in a circumferential part of the exhaust port 86, which port is a high temperature part in the cylinder head 81, is supplied into the cylinder coolant passages. Thus, the above mentioned problems such as increase of friction energy loss due to piston movement and diminishing of the sealing property for sealing coolant between the cylinder block 82 and the cylinder liner 83 can also be solved. Also, an advantage is obtained because all coolant is supplied to the coolant passage 120 which improves the cooling ability for the cylinder parts. This advantage is obtained in the fifth embodiment of the system as well as in the third embodiment of the system.

Further, application of the inventive philosophy of these third through fifth embodiments is not limited to the above mentioned embodiments, but, for example, in FIG. 8, a construction such that a coolant flow will be distributed into the cylinder coolant passage of each of the cylinders from the cooling passage 93 located in a central position of the cylinder head 81 is possible. Also more than three coolant passages can be provided in the cylinder head 81 as necessary for controlling flow rates in the passages.

In the inventive philosophy of these third through fifth embodiments, coolant-flow rate of a coolant flow distributed into each of the cylinder coolant passages from a main coolant passage increases because all coolant is supplied into the main coolant passage so as to increase a pressure of the coolant in the main coolant passage. Thus, it is possible to improve cooling ability for cooling cylinder parts, so that the inventive philosophy of the present invention greatly contributes to making the cooling system of the internal combustion engine most suitable.

Figure 14A:
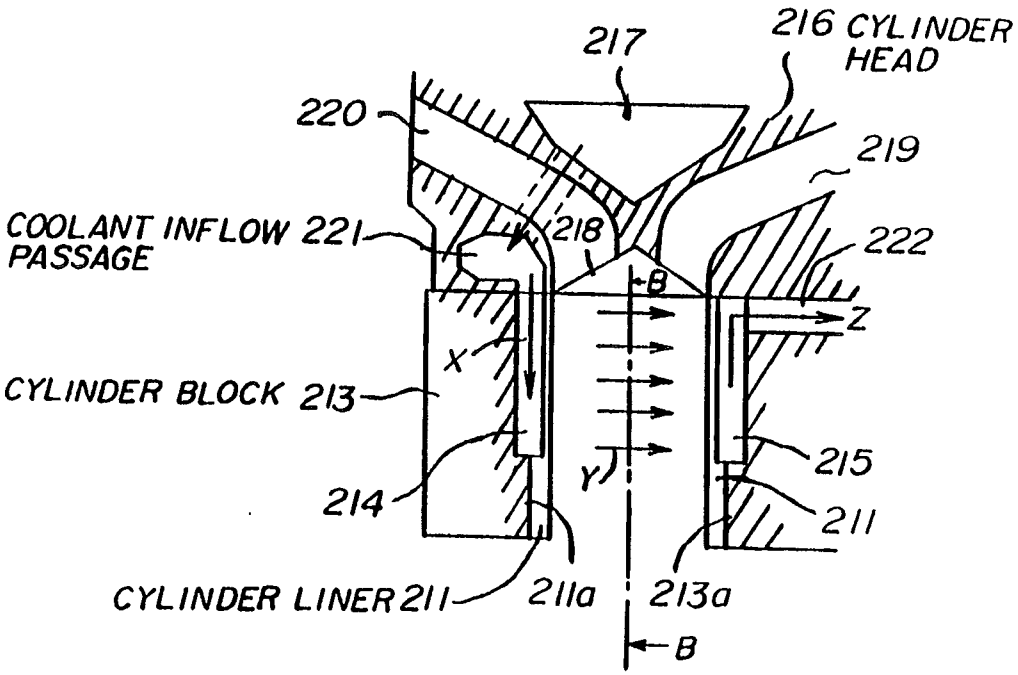
FIGS. 14A and 14B respectively show general sectional views of parts of a sixth embodiment of a cooling system according to the present invention.
Figure 14B:
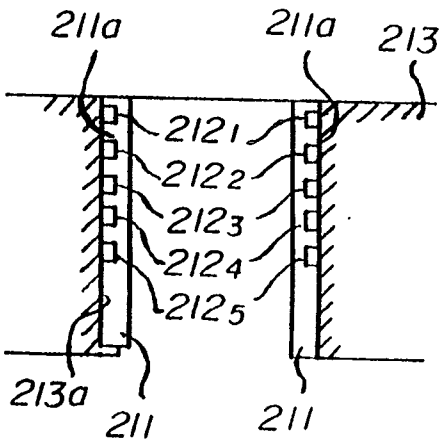

A general construction of a sixth embodiment of the cooling system of an internal combustion engine according to the present invention will be described in conjunction with FIGS. 14A and 14B. The FIG. 14A shows a sectional view of the construction and FIG. 14B shows a sectional view seen along a line B—B shown in FIG. 14A. In the drawings, 5 ring-shaped grooves $212_1$–$212_5$ are located in a column along a longitudinal axial direction of a cylinder liner 211. Each of grooves $212_1$–$212_5$ extend along a circumferential direction of the cylinder liner 211 and are formed on the cylinder liner 211. A bore part 213*a* is provided in a cylinder block 213, the bore part having an inner diameter equal to the outer diameter of the cylinder liner 211. The cylinder liner 211 is fitted in the bore part 213*a* of the cylinder block 213 so that the 5 pieces of ring-shaped passages are thus formed of the ring-shaped grooves $212_1$–$212_5$ and an inner surface of the bore part 213*a*.

Further, on both an outer surface of the cylinder liner 211 and an inner surface of the bore part 213*a* of the cylinder block 213, longitudinal grooves 214 and 215, each extending along the longitudinal axial direction of the cylinder liner 211, are formed as shown in FIG. 14A. These grooves 214, 215 connect the ring-shaped grooves $212_1 212_5$ with each other. The longitudinal grooves 214, 215 are respectively located on sides diametrically opposite to each other. The first and second connecting passages respectively connect the 5 ring-shaped passages with each other and consist of grooves 214 and 215 respectively.

A circumferential system (the system is not shown in FIGS. 14A and 14B, and the system is to be located in a circumferential of the construction shown in the FIGS. 14A, 14B) for supplying coolant to the 5 ring-shaped passages and the 2 connecting passages of the embodiment shown in the FIGS. 14A and 14B is substantially the same as a circumferential system of the cooling system shown in the FIG. 6 or 7 for supplying coolant to the cylinder coolant passages 35*a*–35*d* of the cylinders #1–#4.

In a cylinder head 216 located on a top of the cylinder block 213, a water jacket 217, a combustion chamber 218, passages 219 and 220 and other passages are formed. Further, in the embodiment, the longitudinal groove 214 comprising the first passage, extends up to a higher position, as in FIG. 14A, than the ring-shaped grooves $212_1$ located nearest to the cylinder head 216. A coolant inflow passage 221 is provided in the cylinder head 216 so that the coolant inflow passage 221 is connected with a part of the longitudinal grooves 214, extends up to a higher position than the ring-shaped grooves 212. This coolant inflow passage 221 is also connected with the water jacket 17. Further, one end of a coolant flux passage 222 formed in the cylinder block 213 so as to extend to the right, as in FIG. 14A is connected at a position of the longitudinal groove 15 comprising the second connecting passage where the ring-shaped groove $212_1$ is connected with the longitudinal groove 15.

Next, a function of the embodiment will be described below. Coolant (cooling water in the embodiment) supplied to the coolant inflow passage 221 via the water jacket 217 flows in the longitudinal grooves 214 in a down direction (X direction) as in FIG. 14A, and a coolant flow of the coolant in the longitudinal grooves 214 is distributed into the ring-shaped passages consisting of the ring-shaped grooves $212_1$–$212_5$. Coolant in the ring-shaped passages respectively flows along the outer surface of cylinder liner 211 being given heat from a wall of the cylinder liner 211, and then flowing into the longitudinal grooves 215.

The coolant respectively flowing into the ring-shaped grooves is joined in the longitudinal grooves 215, flowing in a upper direction as in FIG. 14A, then flowing into the coolant flux passage 222, then flowing in a direction to the right as in FIG. 14A, and then returning to a discharging pump (not shown in the drawing) as shown in a direction Z of FIG. 14A. During flow as mentioned above, the coolant cools the wall of the cylinder liner 211.

As mentioned above, in the embodiment, coolant flowing into the coolant inflow passage 221 begins to flow in the longitudinal grooves 214 at the higher position as in FIG. 14A than the position of the ring-shaped groove $212_1$ nearest to the cylinder head 216, and flows in the longitudinal grooves 214 in the longitudinal axial direction of the cylinder liner 211. Thus, the coolant flows into the ring-shaped groove 212 turning approximately in a right angle from the longitudinal grooves 214 just as the coolant flowing into ring-shaped grooves $212_2$–$212_5$. Therefore, it is possible to obtain an approximately uniform coolant-flow-rate-distribution property for coolant flowing into the ring-shaped grooves $212_1$–$212_5$ because all conditions of pressure loss due to bending of flowing passage and reduction of the flowing area for coolant flowing into the ring-shaped grooves $212_1$–$212_5$ are approximately uniform. However, the ring-shaped groove nearer to the cylinder head 216 has a larger flow rate of coolant because coolant flows into the longitudinal grooves 14 from a side of the cylinder head 216.

Figure 3:
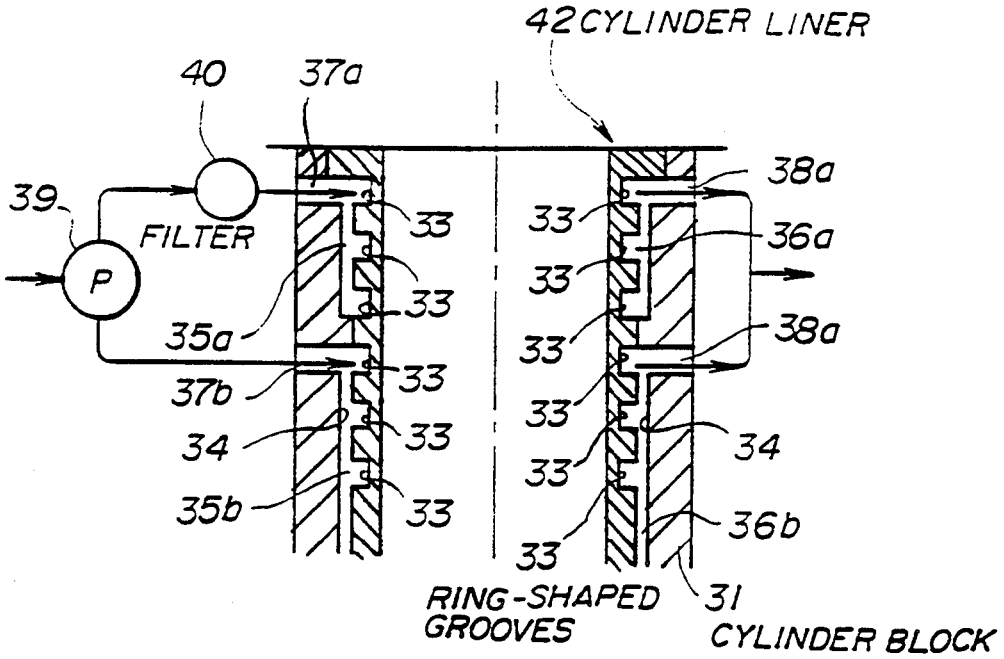
FIG. 3 (RELATED ART)
FIG. 3 shows a sectional view of one example cooling system disclosed previously by the present applicant.
Figure 4:
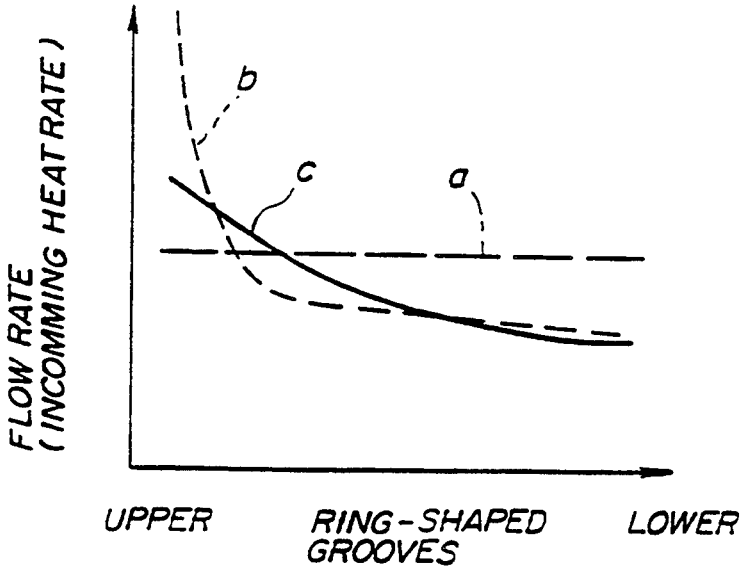
FIG. 4 (RELATED ART)
FIG. 4 shows a distribution of a flow rate of coolant and a distribution of incoming heat rate in a cylinder liner.

Thus, in the embodiment, a flow rate of coolant flowing into the ring-shaped passage consisting of the ring-shaped groove 212,, which passage is located at a position nearest to the cylinder head 216, is larger than, but not extremely large in contrast to a flow rate of coolant flowing into the ring-shaped passage consisting of the ring-shaped groove 212 adjacent to the ring-shaped passage consisting of the ring-shaped grooves 212. Therefore, it is possible to make cooling properties correspond more closely to an incoming-heat distribution as shown by the solid line curve 'c' of FIG. 4 than in the related technology. Thus, a more uniform cooling of the cylinder liner 211 is available in the system of the embodiment as shown in FIGS. 14A and 14B than in the above mentioned related cooling system as shown in FIG. 3.

Further, it is possible to simplify a cooling system for distribution of coolant into each of the cylinders from the cylinder head 216 because of the omission of connecting passages interconnecting the cylinders other than the coolant inflow passage, by means of which passage coolant is supplied to each of cylinders.

Therefore this construction as shown in FIGS. 14A and 14B is very useful for an actual use.

Further, it is not necessary to locate longitudinal grooves 214 and 215 in a position diametrically opposite to each other.

A construction of a part of a seventh embodiment of a cooling system according to the present invention will be described below in conjunction with FIGS. 15 and 16.

Figure 15:
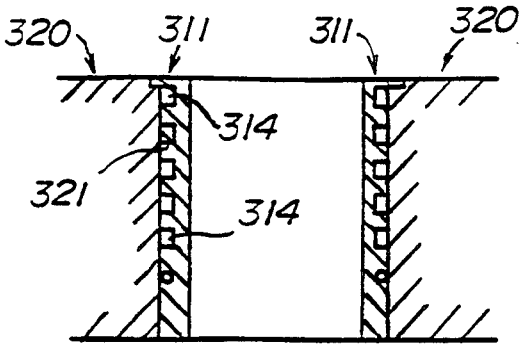
FIG. 15 shows a general sectional view of a part of seventh embodiment of a cooling system according to the present invention.
Figure 16:
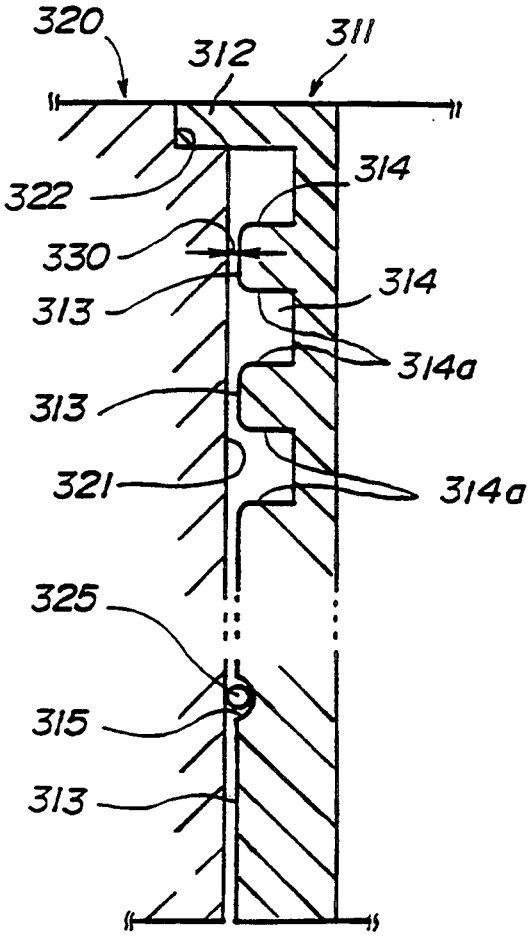
FIG. 16 shows a magnified view of a part shown in the FIG. 15.

In the drawings, a cylinder liner 311 made of steel has a cylindrical shape, the cylinder liner 311 having a rim part 312 at the top thereof, as in FIGS. 15 and 16. In an outer surface of the cylinder liner 311 except for the rim part 312, a plurality of ring-shaped grooves 314 are provided having a rectangular-shaped sectional area and having a several millimeter depth in a radial direction of the cylinder liner 311. Each of the ring-shaped grooves extend along a circumferential direction of the cylinder liner 311. The ring-shaped grooves 314 are located in a row along the longitudinal axial direction of the cylinder liner 311. The ring-shaped grooves 314 are separated apart from each other at equal intervals. Each of the ring-shaped grooves 314 is connected with each other by means of connecting grooves (not shown in the drawings). Each of the connecting grooves is formed in a position diametrically opposite to each other.

A circumferential system (the system is not shown in FIGS. 15 and 16, and the system is to be located in a circumference of the construction shown in FIGS. 15 and 16) for supplying coolant to the the ring-shaped grooves 314 and the connecting passages of the embodiment shown in FIGS. 15 and 16 is substantially the same as a circumferential system of the cooling system shown in FIG. 6 or 7 for supplying coolant to the cylinder coolant passages 35*a*–35*d* of the cylinders #1–#4.

A portion between the above mentioned outer surface 313 of the cylinder liner 311 and a side wall 314*a* of each of the ring-shaped grooves 314 has been given curved- surface-cutting so as to form round shaped surface as shown in FIG. 16.

Further, a ring-shaped groove 315 for retaining an O-ring therein is provided on the cylinder liner 311 near a bottom end thereof.

A bore part 321 for the cylinder liner 311 to be fitted therein formed in a cylinder block 320, which cylinder block 320 is made of aluminium alloy, has an inner diameter a little larger (for the example of the embodiment, about several times greater than ten microns) than an outer diameter of the cylinder liner 311. Further, at a top end of the bore part 321, a ring-shaped cut out part 322 is formed for the rim part 312 to fit therein.

The following explains the assembly process for the cooling system of this example of the embodiment. Firstly, the O-ring 325 is fitted in the ring-shaped groove 315 of the cylinder liner 311, then the cylinder liner 311 is inserted in the bore part 321 of the cylinder block 321, then the rim part 312 is fitted in the cut out part 322, then the cylinder liner 311 is fitted in the bore part 321.

As mentioned above, since the inner diameter of the bore part 321 is a little larger than the outer diameter of the cylinder liner 311, a clearance 330 is formed between them over the entire circumference thereof. A dimension of the clearance 330 is about several times greater than ten microns. That is, sufficiently smaller than a depth in a radial direction of the cylinder liner 311 of each of the ring-shaped grooves 4 of the cylinder liner 311. The depth is, for this example of the embodiment, several millimeters. Therefore, almost all coolant in the ring-shaped grooves 314 of the cylinder liner 311 and the bore part 321 of the cylinder block 320 flows along the coolant passages except for a small amount of coolant leaking to an adjacent passage thereof. This leaking coolant flows in the clearance 330, the amount of the coolant leaking being negligible.

In the above mentioned construction, the outer surface of the cylinder liner 311 is not in contact with the inner surface of the bore part 321 of the cylinder block 320. In this construction, the cylinder liner 311 can perform a large shock absorbing function if an inner wall of the cylinder liner 311 is deformed due to a side pressure of a piston or a combustion pressure. Thus, it is possible to prevent a mirror abrasion of the inner wall of the cylinder liner 311, to prevent diminishing of an oil-remaining property and also to restrict a piston noise.

Figure 5:
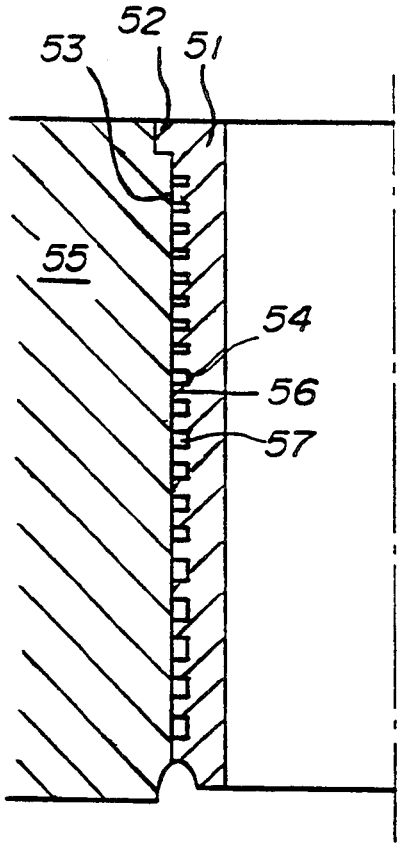
FIG. 5 (RELATED ART)
FIG. 5 shows a partial sectional view, in which a cylinder liner is contact with a cylinder block relating to the present invention.

Further, in a condition where the cylinder liner 311 is fitted in the cylinder block 320, only the rim part 312 is in contact with the cut out part 322. Therefore, an area of contact between the cylinder liner 311 and the cylinder block 320 is smaller than in the related example shown in FIG. 5. Thus,electrolyte etching, resulting when there is contact of metals different from each other, can be prevented. Therefore, this construction is very useful for actual use.

Further, each of corners between the outer surface 313 of the cylinder liner 311 and the side walls 314*a* of the ring-shaped grooves 314 is curved so as to have a round-shaped surface. Thus, even if the outer surface 313 of the cylinder liner 311 comes in contact with the inner surface of the bore part 321 due to deformation of the inner wall of the cylinder liner 311 resulting from side pressure of a piston or from combustion pressure, breakage of the inner surface of the bore part 321 is prevented.

Although the ring-shaped grooves 314 are formed on the outer surface 131 of the cylinder liner 311 in the above embodiment, the coolant passages on the cylinder liner 311 are not limited to the shape in the embodiment but may be formed, for example, in spiral-shaped grooves, as an alternative to the ring-shaped one.

Further, the cooling systems as shown in FIGS. 14A, 14B, 15 and 16 respectively also have advantages, which advantages can be obtained in the systems as shown in the FIGS. 6 and 7 because the systems as shown in the FIGS. 14A–16 are respectively supplied coolant by the same means as those of the systems of FIGS. 6 and 7.

Further, the present invention is not limited to these preferred embodiments, and various variations and modifications may be made without departing from the scope of the present invention.

What is claimed is:

1. An internal combustion engine comprising:

a cylinder block having at least two separate chambers, each of said two separate chambers being configured to receive a cylinder liner therein;

a plurality of cylinder liners, each of said plurality of cylinder liners being provided in one of said at least two separate chambers and having grooves provided on their outer surface;

a plurality of separate coolant flow passage means; wherein each of said plurality of coolant flow passage means is formed between each of said at least two chambers and its associated cylinder liner for directing a flow of coolant therein;

delivering means for individually delivering coolant to each of said plurality of coolant flow passage means; and a cylinder head defining therein a cylinder head coolant passage, wherein said delivering means comprises a portion of said cylinder head coolant passage and a plurality of branch passages, each of said plurality of branch passages are connected to said cylinder head coolant passage and one of said plurality of coolant flow passage means, and wherein the coolant delivered into each coolant flow passage means is heated during flow of the coolant through said cylinder head coolant passage before and upon being branched out into each coolant passage at said plurality of branch passages.

2. The internal combustion engine of claim 1, further comprising:

coolant cooling means for cooling coolant having been heated by flowing through said cylinder head coolant passage and said coolant flow passage means; and coolant circulating means for circulating coolant so as to make coolant flow in said cylinder head coolant passage, said plurality of coolant flow passage means, and said coolant cooling means.

3. The internal combustion engine of claim 2, further comprising a connecting passage, wherein coolant having passed through said cylinder head coolant passage and said plurality of coolant flow passage means flows into said coolant cooling means via said connecting passage, and coolant having passed through said coolant cooling means flows into said cylinder head coolant passage.

4. The cooling system according to claim 2, wherein said cooling system comprises two coolant circulating loops, and wherein:

said first loop comprises coolant flowing through said cylinder head coolant passage, then through said plurality of coolant flow passage means, and then returning into said cylinder head coolant passage; and said second loop comprises coolant flowing through said cylinder head coolant passage, then through said coolant cooling means, and then returning into said cylinder head coolant passage.

5. The cooling system according to claim 1, wherein each of the plurality of coolant flow passage means comprises a coolant groove formed on at least one of an inner wall of a cylinder block and an outer wall of a cylinder liner, said cylinder liner being fitted in said cylinder block, a clearance being provided between said inner wall of the cylinder block and said outer wall of the cylinder block except for a position where each of said coolant passages is located, and said clearance being sufficiently smaller than a radial-direction depth of said coolant groove.

6. The cooling system according to claim 5, wherein said coolant groove is located so as to extend approximately along a circumferential direction of said cylinder liner, and a plurality of said coolant grooves are located in a row along a longitudinal axial direction of said cylinder liner.

7. The cooling system according to claim 1, wherein each of said coolant flow passage means comprises a plurality of coolant passages located along a row along a longitudinal axial direction of a cylinder liner, each of said coolant passages extending approximately along a circumferential direction of said cylinder liner, said cooling passages being provided between an inner wall of a cylinder block and an outer wall of said cylinder liner, said cylinder liner being fitted in said cylinder block, and each of said coolant flow passage means also comprising a coolant inflow passage for supplying coolant to each of said plurality of coolant passages; and said plurality of coolant passages and said coolant inflow passage being located so that each of pressure losses of coolant respectively flowing through positions where coolant are supplied to said plurality of coolant passages from said coolant inflow passage is roughly identical to each other.

8. The cooling system according to claim 7, wherein said coolant inflow passage extends outside of a row of said plurality of coolant flow passage means, and coolant flows into said coolant inflow passage in said portion outside of said row of said plurality of coolant flow passage means, said coolant flowing into each of said plurality of coolant flow passage means.

9. The coolant system according to claim 8, wherein said coolant inflow passage extends outside of said cylinder liner.

10. The cooling system according to claim 1, wherein said cylinder head defines therein a plurality of coolant passages constituting said cylinder head coolant passage, each of said plurality of passages being located in said cylinder head and wherein said plurality of coolant passages are connected with each other.

11. The cooling system according to claim 10, wherein said plurality of coolant passages comprises a first coolant passage having said branch passages therein, each of said branch passages being connected with a respective one of said plurality of coolant flow passages means; and said plurality of coolant passages passage means also comprises a second coolant passage connected with said first coolant passage.

12. The cooling system according to claim 10, wherein each passage of said plurality of coolant passages extends along a longitudinal axis of said cylinder head, said cylinders also located along said longitudinal axis, and said plurality of coolant passages comprise a first coolant passage having said branch passages therein, each of said branch passages being connected with a respective one of said plurality of coolant flow passage means; and said plurality of coolant passages also comprises a second coolant passage connected with said first coolant passage so as to be provided with coolant from said first coolant passage.

13. The cooling system according to claim 12, wherein said first coolant passage is located so as to be adjacent to an inlet port provided in said cylinder head, and so as to be apart from an exhaust port provided in said cylinder head.

14. The cooling system according to claim 12, wherein said first coolant passage is located so as to be adjacent to an exhaust port provided in said cylinder head, and so as to be apart from an inlet port provided in said cylinder head.

15. The cooling system according to claim 6, wherein each of said plurality of coolant passages extends along a longitudinal axis of said cylinder head, said cylinders also located along said longitudinal axis, and said plurality of coolant passages comprises a first coolant passage having said branch passages therein, each of said branch passages being connected with a respective passage of said plurality of coolant flow passage means; and said plurality of coolant passages also comprises a second coolant passage connected with at least one passage of said plurality of coolant flow passage means so as to be provided with coolant having passed through said one of said plurality of coolant flow passage means.

* * * * *